US005230021A

United States Patent [19]

Paddock

[11] Patent Number: 5,230,021

[45] Date of Patent: Jul. 20, 1993

[54] AUDIO TRANSDUCER IMPROVEMENTS

[75] Inventor: Paul W. Paddock, McMinnville, Oreg.

[73] Assignee: Linaeum Corporation, Portland, Oreg.

[21] Appl. No.: 730,172

[22] Filed: Jul. 12, 1991

Related U.S. Application Data

[63] Continuation-in-part of Ser. No. 708,924, May 31, 1991.

[51] Int. Cl.[5] ..... H04R 25/00

[52] U.S. Cl. ..... 381/202; 381/194; 381/199

[58] Field of Search ..... 381/202, 204, 194, 195, 381/199, 196, 197

[56] References Cited

U.S. PATENT DOCUMENTS

| | | | |
|---|---|---|---|
| 3,686,446 | 8/1972 | Manger | 381/195 |
| 3,978,353 | 8/1976 | Kinoshita | 310/8.1 |
| 4,327,257 | 4/1982 | Schwartz | 179/115.5 |
| 4,472,605 | 9/1984 | Klein | 381/202 |
| 4,584,439 | 4/1986 | Paddock | 381/202 |
| 4,590,333 | 5/1986 | Strohbeen | 179/115.5 |
| 4,897,877 | 1/1990 | Tetzlaff | 381/24 |
| 4,903,308 | 2/1990 | Paddock et al. | 381/202 |

FOREIGN PATENT DOCUMENTS 1123506 5/1982 Canada .

*Primary Examiner*—Jin F. Ng
*Assistant Examiner*—Huyen D. Le
*Attorney, Agent, or Firm*—Klarquist, Sparkman, Campbell, Leigh & Whinston

[57] ABSTRACT

An audio transducer having a pair of magnets supported to provide a magnet gap within which a flexible diaphragm supporting an electrical coil is received. The diaphragm is formed of a pair of flexible cylindrical webs joined at their centers to support the coil within the magnet gap. The diaphragm is provided with a row of perforations on either side of the gap to provide flexibility and is aligned centrally within the gap by flexible foam strips attaching the magnets to the diaphragm.

20 Claims, 8 Drawing Sheets

AUDIO TRANSDUCER IMPROVEMENTS

CROSS-REFERENCE TO RELATED APPLICATION

This is a continuation-in-part of co-pending application Ser. No. 07/708,924, filed May 31, 1991.

TECHNICAL FIELD

This invention generally relates to audio transducers. More particularly, the invention relates to improvements in the design of a transducer with at least one arcuate diaphragm.

BACKGROUND OF THE ART

U.S. Pat. No. 4,903,308, which is incorporated herein by reference, discloses an audio transducer used for producing mid-range to high range frequencies. This transducer has a pair of elongated resilient webs whose intermediate portions are joined together forming an expanse that extends generally in a plane, with the expanse supported for movement in the direction of the plane. This transducer is particularly well suited for high end consumer audio markets in which cost is not a substantial concern. Therefore, the complexity of the assembly and the precise manufacturing processes required do not prevent this transducer from being highly effective and marketable. In addition, overall efficiency of the existing transducer need not be maximized due to the generally adequate power capabilities of typical home audio amplifiers.

The foregoing transducer design is not as well suited for applications in which the manufacturing cost is critical and power is limited, as in portable stereo and car stereo applications. This is true of many other prior transducer designs as well. It is always desirable to reduce manufacturing cost and to increase efficiency for any application, particularly without sacrificing performance. Also, any transducer may be improved by widening its frequency range, especially by improving its high frequency efficiency.

A fundamental problem in extending the range of frequencies in any transducer is the seemingly unavoidable trade-off between the high and low frequency performance of the transducer. Measures to improve high frequency response, such as the use of lighter diaphragm materials, have the effect of diminishing output efficiency at the lower range of the transducer. Measures to improve low frequency response, such as the use of stiffer diaphragm materials, cause high frequency losses.

All prior art devices can benefit by reducing manufacturing costs. High performance transducers generally have numerous complex parts which must be carefully aligned in a labor- and skill-intensive manufacturing process that requires many assembly steps.

A further disadvantage of many prior transducers is that the speaker coil does not easily dissipate the heat that is generated when the transducer is driven under high load conditions. The coil is typically covered by material that thermally insulates the coil.

A further drawback in many prior transducers is the less than optimum high frequency efficiency due to the moving mass of the rigid portion of the diaphragm.

A further disadvantage in the prior art is the efficiency limitation caused by the lack of precision of alignment of the diaphragm relative to the magnet structure. To provide maximum efficiency, the magnets should be closely spaced adjacent the coil. This is especially critical with small, high frequency drivers, which typically use fewer coil turns and, thus, require a high strength magnetic field. The limitation of the prior art, however, is that imprecise positioning of the diaphragm and coil relative to the magnet creates a risk of the diaphragm contacting the magnet structure as the diaphragm vibrates or as misalignment occurs over time and use. Thus, a wide gap is required to tolerate imprecise alignment of the diaphragm and to prevent the unacceptably distorted output that occurs when the diaphragm contacts the magnet.

In the above-referenced prior art transducer, the diaphragms are aligned centrally in the magnet gap by a set of elastic cords, each spanning from one magnet to the other and passing through a small hole defined in the diaphragm. Although the elastic cords are sized to tightly fit the holes defined in the diaphragm, the diaphragm may slightly shift over time. This shift is tolerated by using a wider magnet gap, which results in a lower efficiency transducer unsuitable for applications such as automotive and portable stereos. An additional characteristic of this suspension approach is that the added mass of the elastic cords tends to slightly diminish the high frequency performance of the transducer.

A further characteristic of the prior art transducer making it less than ideal for portable applications, is the further reduced efficiency caused by the larger magnet pole plates, which must extend beyond the magnets to provide a rigid position for the magnets to be secured to each other across the magnet gap above and below the diaphragm, and without interfering with the diaphragm. The securing bars used for this purpose tend to limit the width of the diaphragm, resulting in limited efficiency.

A further disadvantage of all prior art audio transducers is that the diaphragm material has a less than desireable strength-to-weight ratio. In addition, the flexible materials such as the plastics and papers that are commonly used for such applications have a low resistance to solvents and acids and are highly susceptible to degradation in various types of radiation, particularly ultraviolet light as is found in outdoor applications, such as automotive installations.

A further disadvantage of the diaphragm materials used in the prior art is that the plastics and plastic coated papers commonly used have a surface that is generally incompatible with many adhesives, making manufacturing difficult by limiting adhesive choices to those adhesives with other undesirable properties.

SUMMARY OF INVENTION

An object of this invention, therefore, is to provide an improved transducer featuring a construction which overcomes the difficulties and shortcomings indicated.

More specifically, an object of the invention is to provide a transducer with an improved high frequency response without a loss of efficiency or performance at the low end of the transducer frequency range.

Another object of the invention is to provide a high performance transducer that may be inexpensively manufactured, having a small number of parts and requiring few complex manufacturing processes.

Still another object of the invention is provide a transducer wherein the speaker coil may easily dissipate accumulated heat.

A further object of the invention is to provide a transducer having a rigid moving mass of reduced weight.

Yet another object of the invention is provide a transducer wherein the diaphragm may be easily and precisely aligned within the magnet gap to safely permit a narrowed magnet gap such that the alignment remains fixed over use and time.

It is a further object of the invention to provide a transducer with a diaphragm alignment system that does not add appreciable mass to the transducer and which is sufficiently lightweight to avoid damping the vibration of the diaphragm.

A further object of the invention is to provide a transducer having a diaphragm alignment system that distributes suspension forces equally along the length of the diaphragm.

It is a further object of the invention to provide a transducer having a rigid magnet alignment structure that does not limit the width of the diaphragm employed.

A further object of the invention is provide a transducer with a diaphragm constructed from a material that has a high strength-to-weight ratio, is resistant to solvents and acids, which resists degradation on exposure to ultraviolet radiation, which has a surface that is compatible with a wide variety of standard adhesives, and which is highly thermally transmissive without warpage at high temperatures and temperature differentials.

These and other objects and advantages of the invention will become more fully apparent as the description which follows is read in conjunction with the accompanying drawings.

DETAILED DESCRIPTION OF THE INVENTION

Figure 1:
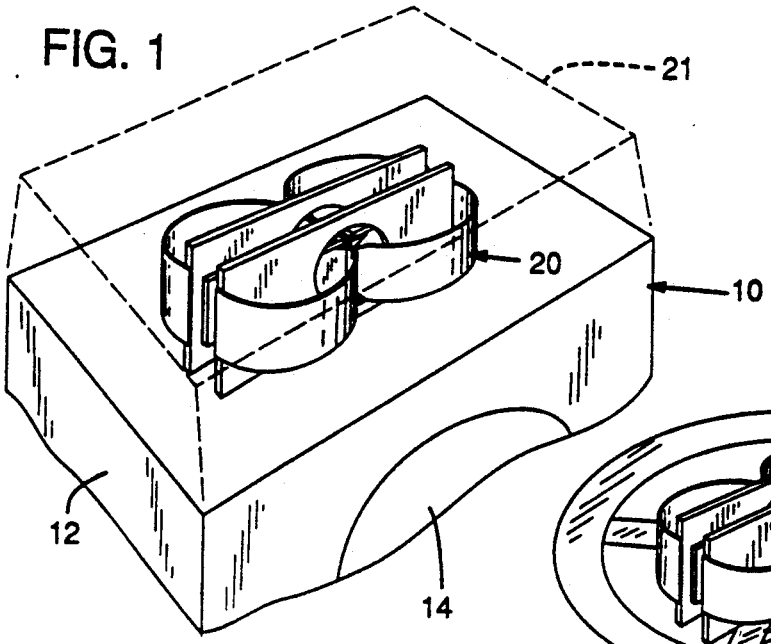
FIG. 1 is a perspective view of a transducer according to the present invention used in one application as a high frequency transducer attached to a standard low-frequency speaker with a cone driver.

FIG. 1 shows a book shelf speaker 10 embodying the present invention in the application. The speaker includes a standard box-type enclosure 12 with a cone driver 14 for producing low- and mid range frequencies. A high frequency transducer 20 in accordance with the present invention is mounted to the top of the enclosure 12. The driver 14 and high frequency transducer 20 are electrically connected to a standard cross-over network (not shown) so that the high frequency transducer 20 receives frequencies over 2,000 Hz and the driver 14 receives frequencies below 2,000 Hz. This cross-over point may be varied to suit the needs of the particular application. An acoustically transparent grille 21 (shown in dashed lines) may be provided to protect the speaker from dust and damage, and to provide an aesthetic appearance.

Figure 2:
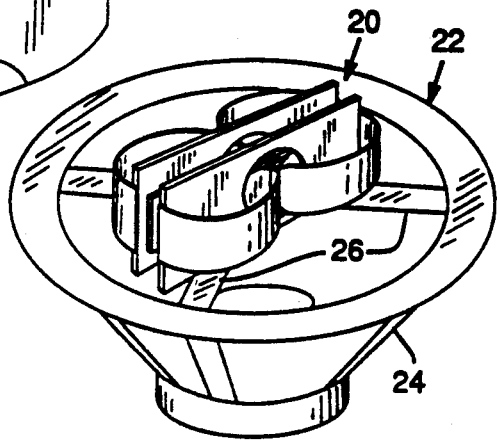
FIG. 2 is a perspective view of the transducer of FIG. 1 as mounted to an automobile low frequency cone driver.

As a second exemplary application of the present invention, FIG. 2 shows an automotive speaker 22 for mounting in a typical rear deck position of an automobile interior. A standard upward facing cone-type low- or mid-range driver 24, such as a typical 6"×9" woofer, is oriented horizontally with its diaphragm facing upward. The high frequency transducer 20 is rigidly suspended above the diaphragm of the driver 24 by horizontal brackets 26 that allow substantial open space for the sound emitted by the driver 24 to be upwardly projected. The high frequency transducer 20 thereby protrudes above the rear deck (not shown) and transmits sound directly forward toward the automobile passengers. The high frequency transducer 20 and driver 24 are interconnected by a cross-over network (not shown) as discussed above with reference to speaker 10 of FIG. 1. A protective grille (not shown) may be used to shroud the speaker 22.

Figure 3:
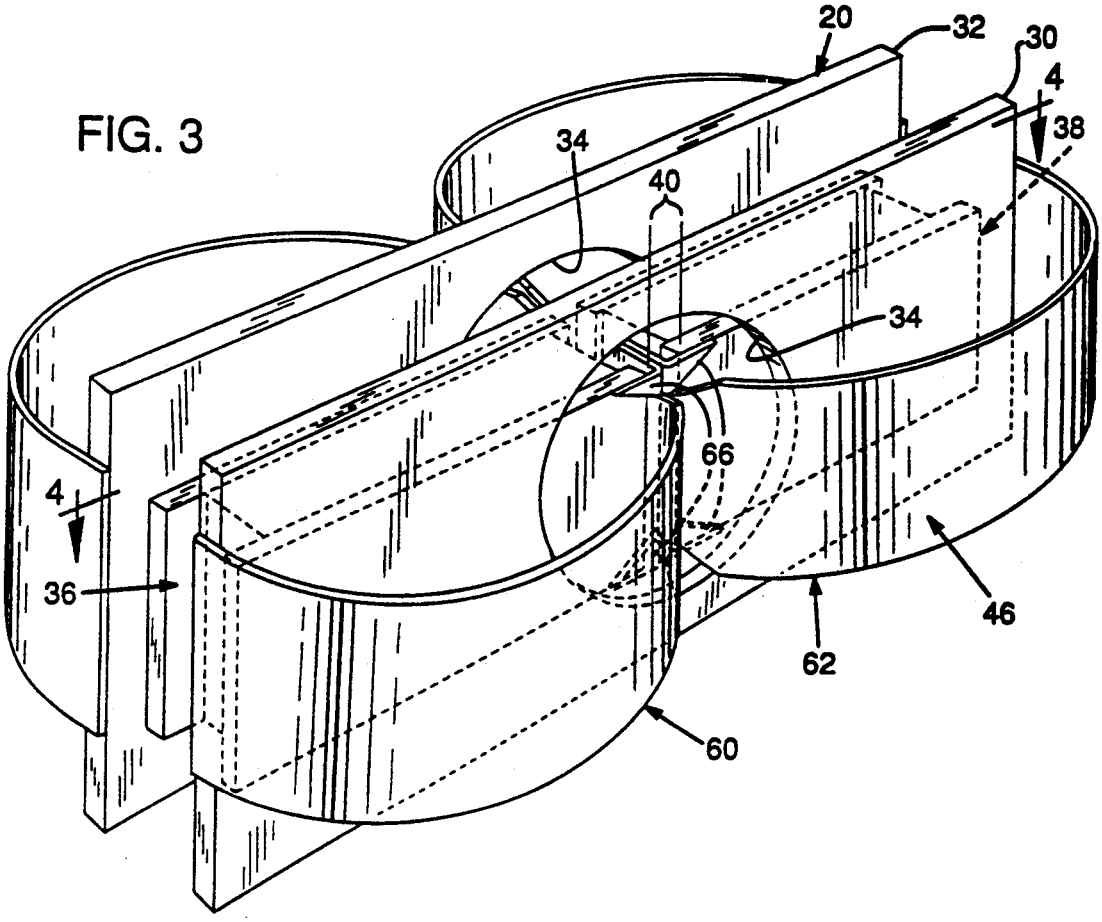
FIG. 3 is a perspective view of the transducer of FIG. 1.

As shown in FIG. 3, the high frequency transducer 20 is generally of a rigid, layered construction. This construction includes a chassis or frame having a front chassis plate 30 and a rear chassis plate 32. Plates 30, 32 are vertically oriented rectangular plates made preferably of a rigid plastic material. The plates are identical to one another and oriented in a parallel, laterally spaced relationship. Each plate defines a circular central aperture 34 having a diameter that is a substantial fraction of the height of the chassis plates 30, 32, to permit passage of large items without sacrificing rigidity. The apertures of the plates are in registration with one another. A first magnet assembly 36 and a second magnet assembly 38 are supportively sandwiched between the chassis plates 30, 32 with the chassis plates adhesively affixed thereto to provide a rigid chassis structure. The magnet assemblies 36, 38 thereby provide a fixed magnetic field suitable for interaction with a coil carrying an electrical current as will be discussed below. The magnet assemblies 36, 38 are rigid rectangular structures arranged symmetrically and orthogonally between the chassis plates 30 32 to define a magnet gap 40 of constant width therebetween. The magnet gap 40 extends vertically the full height of the magnet assemblies and if extended laterally, would bisect the central apertures 34. Thus, the centers of the apertures are aligned with the magnet gap.

To maximize speaker efficiency, the magnet gap should be as narrow as possible while allowing sufficient clearance to permit passage of a planar diaphragm 46 as will be discussed below. The ideal gap width varies depending on the size of the transducer and application being fulfilled. The magnet gap 40 may range between 0.020 and 0.062 inch, with a spacing of inch being preferred in the particular high frequency transducer 20 illustrated.

Figure 4:
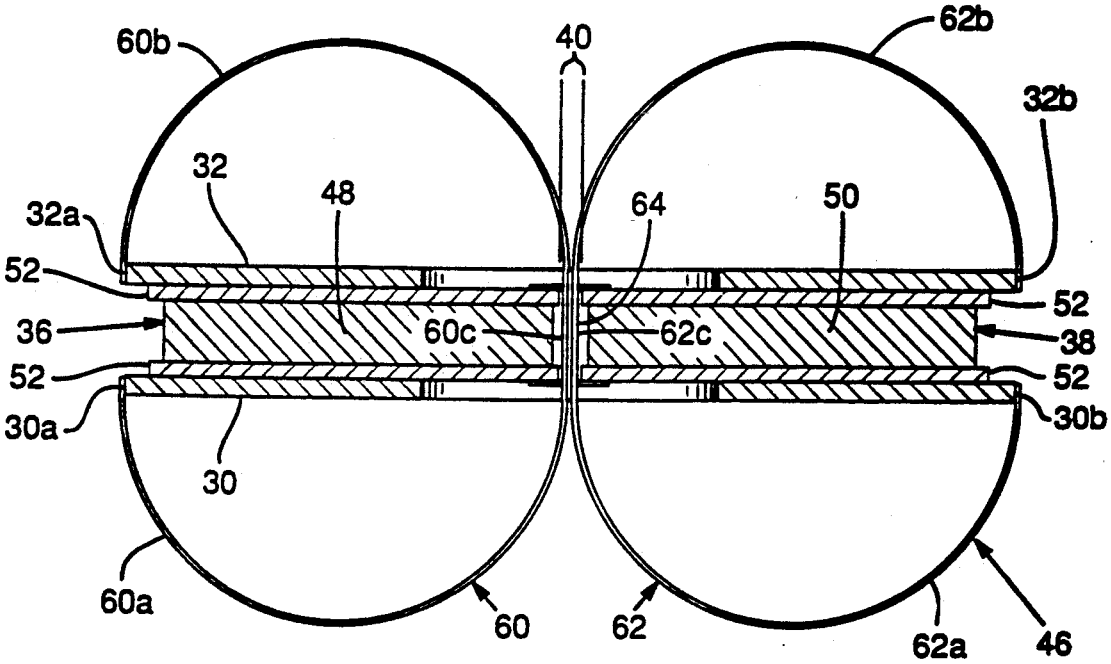
FIG. 4 is a cross-sectional view taken along line 4—4 of FIG. 3.

As shown in FIG. 4, each magnet assembly 36, 38 comprises a magnetic core 48, 50, respectively, with a pair of rigid, ferro-magnetic metal pole plates 52 affixed to the opposite sides of each magnetic core. The pole plates 52 are generally coextensive with the magnetic cores 48, 50, extending slightly beyond the magnetic cores in the direction of the magnet gap 40 so that the separation between opposed pole plates 52 defines the magnet gap. The magnetic cores 52 are magnetically oriented so that each pole plate is of opposite magnetic polarity from the other pole plate attached to the same magnetic core and so that each pole plate 52 is also magnetically opposite from its counterpart across the magnet gap 40.

It will be apparent from the foregoing that each chassis plate is adhered to one of the pole plates of each magnet assembly to provide a sandwich construction which is perfectly symmetrical.

The diaphragm 46 is formed of a pair of elongate resilient webs 60, 62. The paired structure provides a symmetrical structure, but a single diaphragm may be used where this characteristic is unnecessary. Each web includes flexible curved portions forming the end of each web, joined to and extending from an intermediate, generally planar central portion 64 also indicated in FIG. 5. Web 60 includes a front curved portion **60*a*, a rear curved portion 60*b* and a central expanse 60*c*. Web 62 includes a front curved portion 62*a*, a rear curved portion 62*b* and a central expanse 62*c*. The central expanses 60*c*, 62*c* of the two webs are joined together, as with an adhesive, to form the central portion 64. The central portion 64 is an essentially rigid unit functioning as a narrow beam, and is movable generally in the plane occupied by the expanse. That is, it moves perpendicularly to the plane of the chassis plates 30, 32**. Thus, the central portion is movable laterally relative to the transducer as a whole.

The diaphragm 46 is preferably constructed of an aramid fiber paper sheet such as Nomex®, produced by duPont, but other flexible, lightweight, high-strength, environmentally stable materials may be used.

The central portion 64 of the diaphragm 46 is suspended centrally within the magnet gap 40 by the flexible curved portions **60*a*, 60*b*, 62*a*, 62*b*. The end of each flexible curved portion is attached adhesively to a respective end portion 30*a*, 30*b*, 32*a*, 32*b* of each chassis plate 30, 32 so that each flexible portion forms a semicircular shape, giving the diaphragm the general shape of a figure-eight when viewed from above or below. The curved portions of each web define curved surfaces which extend through respective central apertures 34 to meet at the expanse. The curved portions 60*a*, 60*b*, 62*a*, 62*b* primarily act as flexible suspension members and not as sound radiating surfaces. This is particularly true at high frequencies, at which only the portions of the diaphragm 46 closest to the center portion 64** are actively radiating sound. Thus, alternate suspension devices may be used without impairing the function of the invention, particularly at high frequencies.

Figure 5:
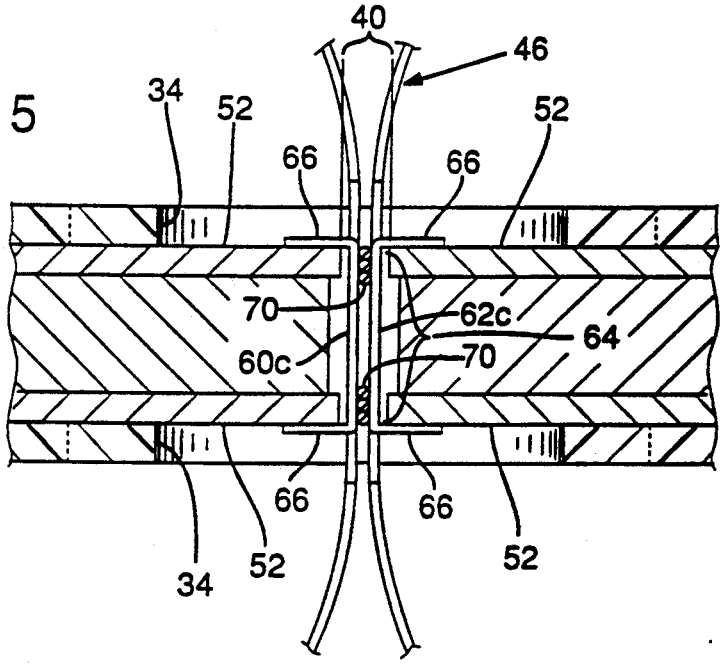
FIG. 5 is an enlarged cross-sectional view taken along line 4—4 of FIG. 3 showing the structure in the vicinity of the electrical coil.

FIG. 5 shows the central portion 64 of the diaphragm 46 that resides within the magnetic gap 40. As will be discussed below with reference to FIG. 6, a set of tab portions or tangs 66 are partially cut from the diaphragm 46 and folded perpendicular to the central portion 64 of the diaphragm so that they extend in planes substantially coincident with the exterior surfaces of the pole plates 52, to which the free ends of the tangs 66 are adhesively attached. The central apertures 34 are large enough to expose a sufficiently large area of the exterior surfaces of the pole plates 52 to permit the tangs to be attached thereto. As a result, the central portion 64 is maintained in the central location between the magnets while being free to move laterally within its own plane by a sufficient amount to produce high audio frequencies. The tangs 66 prevent longitudinal movement of the central portion 64 of the diaphragm 46, while permitting unimpaired lateral movement in the plane of the central portion 64.

FIG. 5 further illustrates an electromagnetic coil 70 laminated between the central expanses **60*c*, 62*c* of the web 60, 62 to become a rigid portion of the central portion 64. The vertical portions (shown in cross-section) of the coil 70 are positioned in the regions immediately between the pairs of opposed pole plates 52**.

Figure 6:
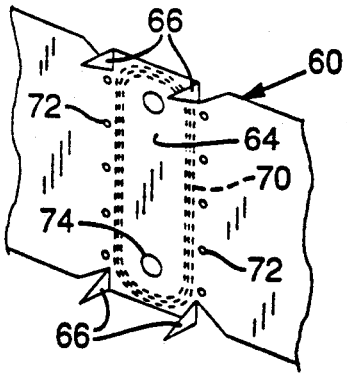
FIG. 6 is a fragmentary perspective view of an alternate diaphragm embodiment of the apparatus of FIG. 3 in preassembled form with triangular tangs extended.

FIG. 6 shows web 60 in a straightened, partially preassembled condition with triangular tangs 66 cut and folded in position for attachment to the magnet pole pieces 52. In this embodiment, one edge of each tang is an extension of either the upper or lower portion of the web, depending on whether the tang is the upper or lower tang. The coil 70 (shown in dashed lines) is an elongate looped coil of wire forming a vertically oriented generally oblong or rectangular shape, with a pair of opposed straight, vertically oriented wire segment portions being spaced apart to align with the magnet pole pieces 52. Similar tangs are cut in web 62 (not shown) and folded in the opposite direction as those shown, providing a symmetrical diaphragm.

As further shown in FIG. 6, the diaphragm 46 is provided with a vertical row of hinge perforations 72 on each side of the coil 70. The perforations are preferably aligned with the folded tangs 66 and are positioned within about ¼ inch of the coil 70 and hence within about ¼ inch of the joined expanse portion. The tangs are integral extensions of the web formed by folding pre-slitted tab-like portions of the web. Positioning the perforations 72 close to the coil 70 effectively reduces the mass of the rigid center portion 64 of the diaphragm 46. The perforations 72 may be circular as shown or, alternatively, may be any other shape including oblong, square or elliptical and may alternatively be sheared line segments with no diaphragm material removed. FIG. 6 further shows the center portion 64 defining mass reduction holes 74, the advantages of which are discussed below with reference to FIG. 7.

Each row of perforations acts like a hinge to permit a less constrained, more responsive movement of the central diaphragm expanse portion 64. The size of the perforations is not critical, only the proportion of material removed affects the key property of hinge-like flexibility at the edges of the center portion 64. Along the hinge center line of each row of hinge perforations 72, the sum of the linear dimensions of the perforations is preferably between about 10% and 50% of the full linear dimension of the web 60 along the same vertical line. With current materials used, the perforations define a pair of hinge lines at which the web material is preferably about 80% connected and 20% perforated. Thus, it is apparent that the web shown in FIG. 6 is less than 20% perforated and thus less than optimum. The foregoing parameters likely will become better defined with further experimentation.

The added hinge-like flexibility provided by the perforations 72, permits the efficiency of the transducer at very high frequencies to be substantially increased as the rigid central portion 64 of the diaphragm 46 is able to move more independently of the mass of the web curved portions 60*a*, 60*b*, 62*a*, 62*b*. In addition, the reduced mass resulting from the removal of the diaphragm material is the close vicinity of the central portion may also contribute to this effect. Experimental analysis has shown a 3 to 6 db increase in output over the 12 to 24 kHz high frequency range, with no sacrifice in efficiency at the low end of the transducer's output. Previous attempts to provide an improved high frequency efficiency, such as using a lighter and more flexible diaphragm material, have resulted in an undesirable drop off in low frequency performance.

Figure 7:
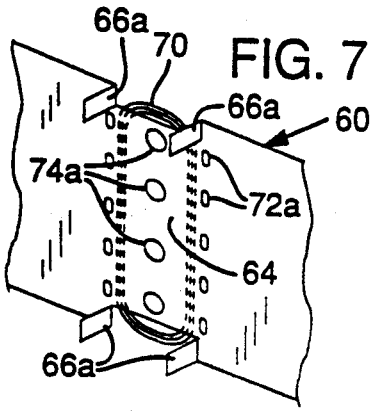
FIG. 7 shows a fragmentary perspective view of an alternate diaphragm embodiment in preassembled form with rectangular tangs extended.

FIG. 7 shows a web 60 having an alternative arrangement of tangs 66*a* and perforations 72*a*. In this embodiment, the tangs are rectangular and folded perpendicularly outward from their original pre-folded positions in the center portion 64 of the diaphragm 46 covering the end portions of the coil 70. While it is generally desirable that the coil be supported by and rigidly affixed to the webs 60 and 62, this is only important along the vertical portions of the coil (shown in dashed lines), which magnetically interact with the magnets shown in FIGS. 3 and 4. The exposed end portions of the coil 70 need not be supported. A further advantage of the FIG. 7 web construction is that the exposed end portions of coil 70 dissipate accumulated heat more effectively, as they are directly exposed to the environment.

The perforations 72 are shown in FIG. 7 as oblongs aligned axially in a vertical row, but any shape may be used as discussed above with reference to FIG. 6. As in FIG. 6, FIG. 7 shows only a single web 60. A similar web 62 would be adhered at the central portion 64 to create a sandwich, with the coil 70 between the webs. FIG. 7 also shows central mass reduction perforations 74 defined in the central portion 64 of the diaphragm, and centered entirely within the coil 70 to reduce the mass of the central portion 64. The central portion 64 is rigid and functions essentially as a planar beam translating in its own plane. The mass reduction provided decreases the inertia of the central portion 64 and results in a slight improvement in high frequency efficiency, with a subjectively perceptible increase in the quality of sound perceived as quickness.

Figure 8:
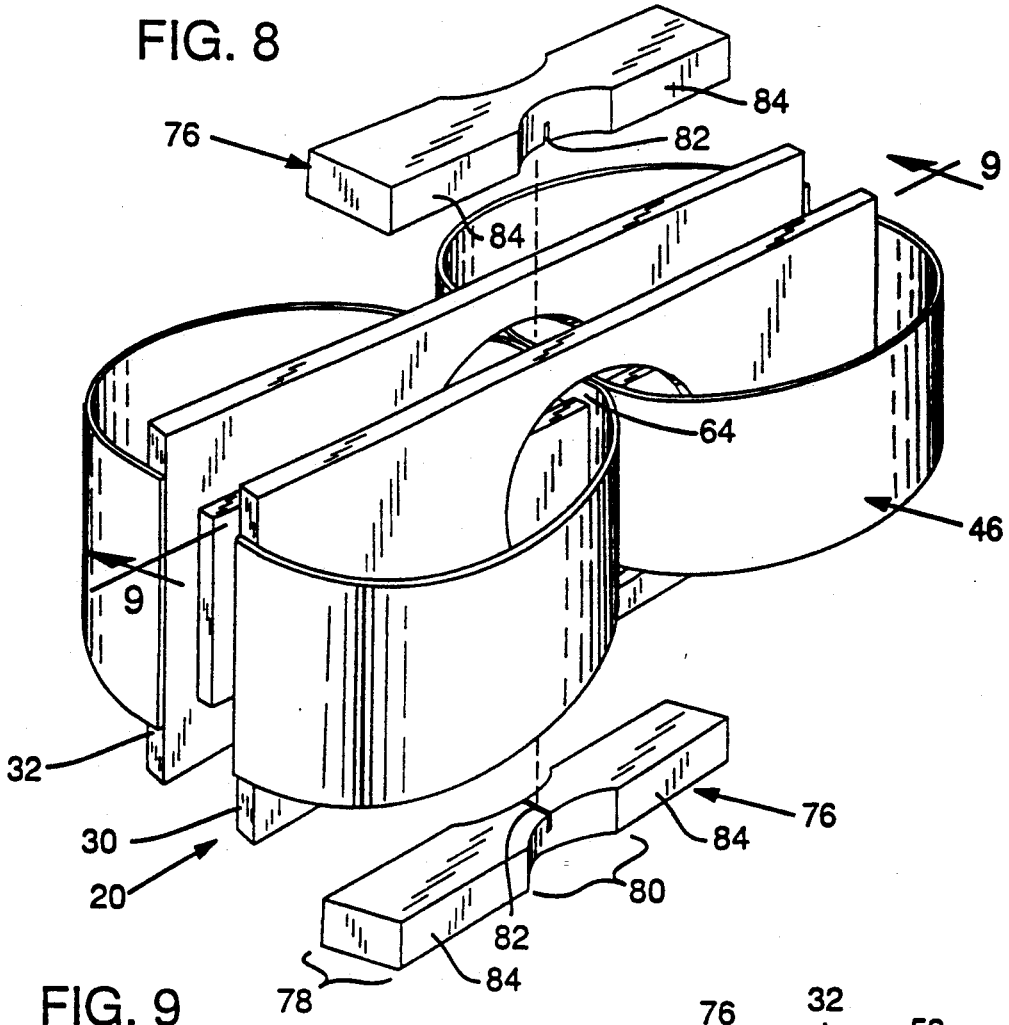
FIG. 8 is a partially exploded perspective view of the transducer of FIG. 3 with an alternative diaphragm centering arrangement.
Figure 9:
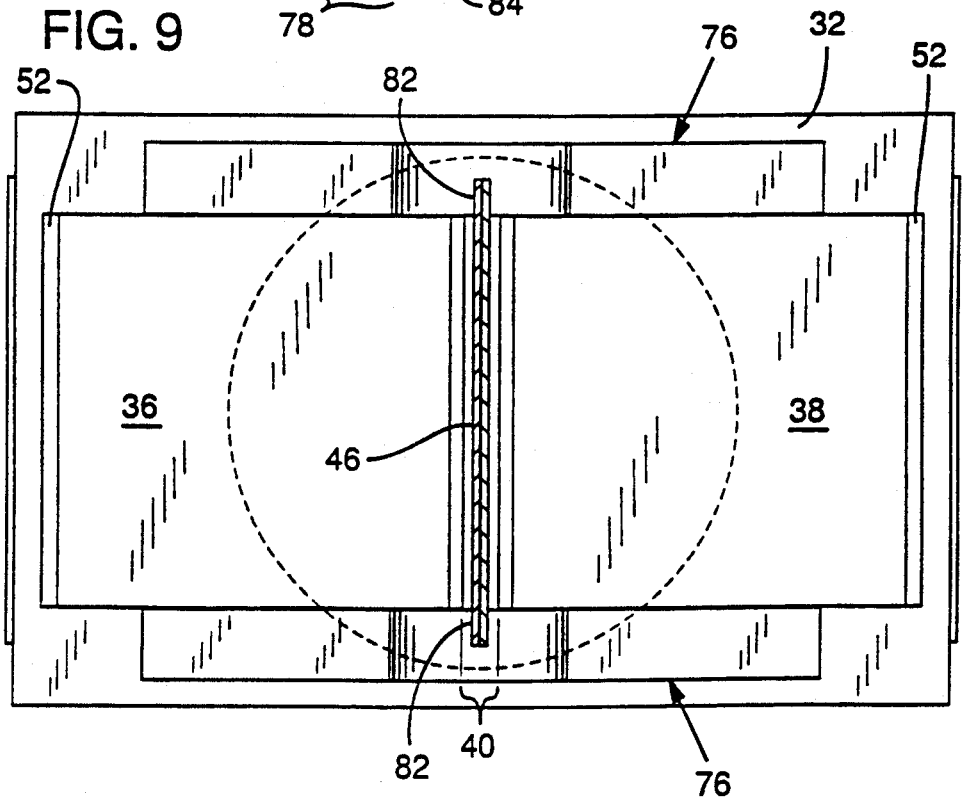
FIG. 9 is a cross-sectional view taken along line 9—9 of FIG. 8.

FIGS. 8 and 9 show the high frequency transducer 20 with an alternative diaphragm centering mechanism. Instead of the tangs 66 formed of the diaphragm 46 to align the diaphragm within the magnet gap 40, as shown in FIGS. 3–7, the embodiment of FIG. 8 uses a pair of elongated foam members 76 to retain the central portion 64 of the diaphragm centrally within the magnet gap 40. Each foam member has a width 78 sized to closely fit between the front and rear chassis plates 30, 32. Each foam member 76 has a slitted central neck portion 80 with a reduced width. A slit 82 is cut across the width of the neck portion to a depth of about one-half the thickness of the foam member. The foam members 76 are attached to the high frequency transducer 20 by mating the slits 82 with the corresponding top and bottom edges of the central portion 64 of the diaphragm 46 and adhesively securing the sides 84 of the foam member 76 to the inner surfaces of the chassis plates so that the foam members rest against the magnets 36, 38 and are entirely positioned between the chassis plates 30, 32. In addition, the slits 82 are adhesively secured to corresponding edges of center portion 64 of the diaphragm 46.

The diaphragm 46 is thereby retained perfectly centered within the magnet gap 40 by the slits 82 provided in the elongated foam members 76. Because the foam members 76 are formed of a lightweight open cell foam having a low resistance to small displacements, they have a negligible damping effect on high frequency vibrations of the diaphragm 46, yet they preserve a central alignment of the diaphragm 46 that is not susceptible to shifting over time.

Figure 10:
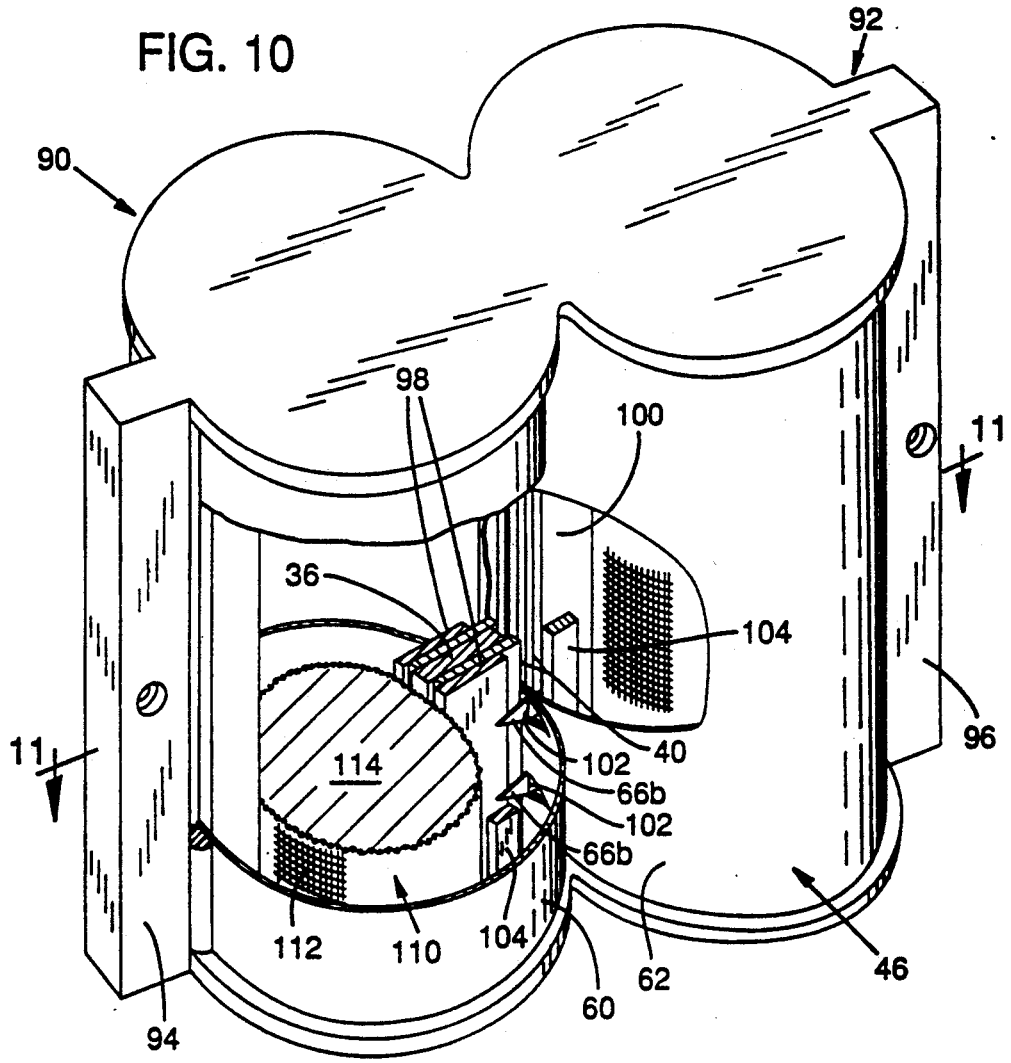
FIG. 10 is a fragmentary perspective view of a mid- and high-frequency transducer constructed in accordance with another embodiment of the invention.
Figure 11:
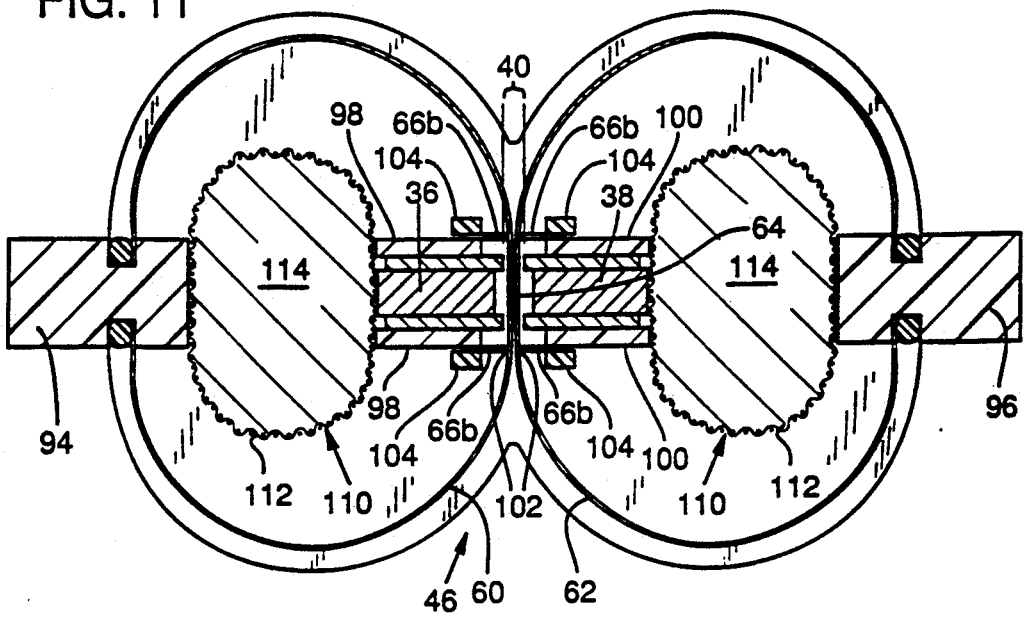
FIG. 11 is a cross-sectional view taken along line 11—11 of FIG. 10.

FIGS. 10 and 11 show a wide range, mid- to high-frequency transducer 90 embodying the invention as an essentially improved version of the audio transducer disclosed in U.S. Pat. No. 4,903,308. Transducer 90 operates on the same general principal as the high frequency transducer 20, with a diaphragm 46 formed by webs 60, 62, as a figure-eight shape. The central portion 64 of the diaphragm 46 passes through the magnet gap 40 (FIG. 11) with a coil 70 (not shown) sandwiched between the webs 60, 62 and residing within the magnet gap in the manner precisely described. In this larger embodiment of the transducer 90, a larger chassis 92 retains the diaphragm 46 and the magnet assemblies 36, 38. The chassis 92 is formed generally of spaced apart vertical diaphragm retaining members 94, 96 and two opposed pairs of central opposed vertical magnet retaining members 98, 100 located between the diaphragm retaining members 94, 96. The magnet retaining members 98 comprise a pair of rigid vertical planar members spaced apart sufficiently so that magnet assembly 36 may be rigidly affixed therebetween to define the magnet gap 40 with the opposite magnet assembly 38, which is similarly affixed between the opposing pair of magnet retaining members 100.

FIGS. 10 and 11 further show a diaphragm centering means including triangular alignment tangs 66*b* formed by V-shaped cuts in each web 60, 62. The apex of each "V" forms a free end that points horizontally away from the central portion 64 of the diaphragm 46. The base of each "V," that is, the portion closest to the central portion 64 of the diaphragm 46 and integrally attached to the diaphragm at a fold line 102, extends substantially perpendicularly from the web in a plane parallel to the exposed exterior surface of the adjacent magnet retaining pair member 98, 100 so that the tang **66*b* may be adhered to or secured against the adjacent retaining member. With the diaphragm 46 suitably centered in the magnet gap 40, the free end tips of the tangs are adhered or clamped to the exposed surfaces of the magnet retaining pair members 98, 100 and covered by rigid elongated tang retaining members 104, which are adhesively affixed to the magnet retaining pair members 98, 100 so that the tips of the tang 66 are sandwiched therebetween. The cuts forming the tangs 66 have the additional advantage of providing a flexible hinge line as discussed above with respect to the hinge perforations 72 and 72*a* of FIGS. 6 and 7. Additional perforations (not shown) between tangs 66*b*** may be provided to increase the diaphragm's flexibility still further.

FIGS. 10 and 11 also show a pair of cylindrical acoustic dampers 110 oriented vertically and positioned between the respective diaphragm retaining member 94, 96 and magnet retaining pair 98, 100 in each chamber defined by the respective circular web 60, 62. Each damper 110 is formed by a cylindrical tube of perforated webbing, such as a flexible plastic mesh 112, which is filled with a core of lightweight fibrous stuffing 114. The stuffing 114 may be any suitable material, such as wool, felt, cellulose fiber or fiberglass. The dampers prevent internal acoustic reflections and vibrations from degrading the output sound.

Figure 12:
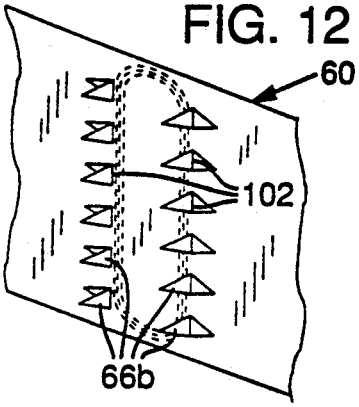
FIG. 12 is a fragmentary perspective view of an alternate diaphragm embodiment of the apparatus of FIG. 10 in preassembled form with alignment tangs extended.

FIG. 12 shows preassembled web 60 of the embodiment of FIGS. 10 and 11 with the tangs **66*b* shown as "V" cuts and folded along fold lines 102. Tangs 66 are arranged in two vertically aligned rows, one row on each side and located about ¼ inch from coil 70. Like tangs 66, tangs 66*b*** are formed as integral folded extensions of the diaphragm.

Figure 14:
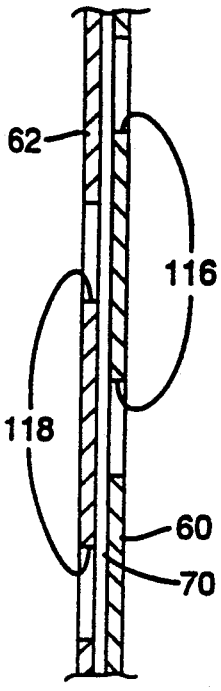
FIG. 14 is an enlarged cross-sectional view of the diaphragm of FIG. 13 taken along line 14—14 of FIG. 13.
Figure 13:
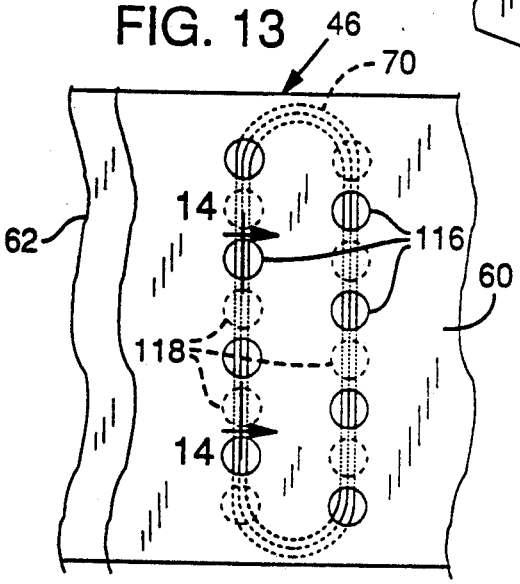
FIG. 13 is fragmentary side view of an alternative diaphragm embodiment of the apparatus of FIG. 10.

FIGS. 13 and 14 show an alternative configuration of the diaphragm 46 for use on the mid- to high-frequency range transducer 90 of FIGS. 10 and 11. Web 60 is provided with a plurality of circular holes 116 arranged in vertical rows registered with the linear vertical portions of the coil 70. The holes 116 are spaced apart in each row by a center-to-center distance greater than twice the diameter of the holes. The holes are staggered in each row so that the holes in one row are aligned with the mid points between centers of adjacent holes in the opposite row. The web 62 is provided with an identical set of holes 118, shown in dashed lines. Webs 60, 62 are registered with the holes 116, 118 aligned in reverse registration so that each hole 116 overlies a solid unbroken portion of adjacent web 62 and each hole 118 underlies a solid, unbroken portion of adjacent web 60. Therefore, there are no openings passing entirely through both webs 60, 62. The coil 70 is adhesively laminated between the webs 60, 62 so that its vertical linear sections are generally aligned with the rows of holes 116, 118. Because of the arrangement of holes 116, 118, every point along the entire length of the coil 70 is adhered either to web 60 or web 62 or both. This prevents any undesirable relative motion between the coil 70 and the webs 60, 62. Because the webs 60, 62 are adhered only to the coil, and not to each other in the region beyond the periphery of the coil, the holes 116, 118 provide the hinge-like flexibility discussed above, and produce high frequency efficiency improvements without sacrificing low frequency efficiency. In addition, heat in the coil 70 is readily dissipated by the substantial portions exposed to air through the holes 116, 118, while performance is maintained with a rigidly attached coil.

Figure 15:
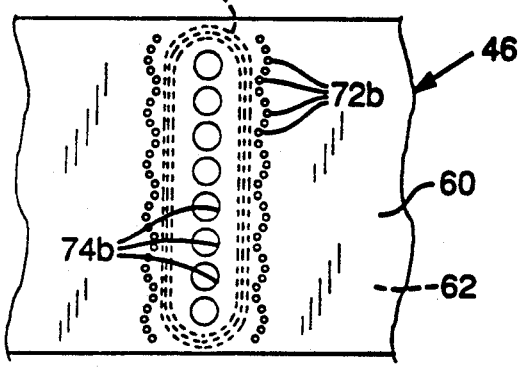
FIG. 15 is a fragmentary side view of an alternate diaphragm embodiment of the apparatus of FIG. 10.

FIG. 15 shows an alternative diaphragm arrangement for the transducer 90 of FIGS. 10 and 11. An articulated row of perforations **72*b* is defined entirely through the diaphragm 46, penetrating both webs 60, 62 on both sides of the coil 70. The perforations as shown are circular, but numerous other shapes are contemplated and may be substituted. The holes 72*b* of this embodiment are separated by at least a minimal distance from the coil 70 to ensure that the coil is entirely adhered to the diaphragm 46. At least a portion of some of the perforations preferably are within at least about ¼ inch of the coil 70 to provide optimal flexibility in the diaphragm 46 for high frequency efficiency. FIG. 15 further shows a centrally aligned row of mass reduction perforations 74*b* positioned in a vertical row within the coil 70. The perforations 74*b* may pass entirely through the diaphragm 46 or may each be defined only in a single web 60 or 62 so that through holes are not provided through the diaphragm. In an alternative embodiment, a thin film or sheet of thin material may be provided between the webs 60, 62 to close the perforations 74*b*** while allowing the advantages of substantial weight reduction.

Figure 16:
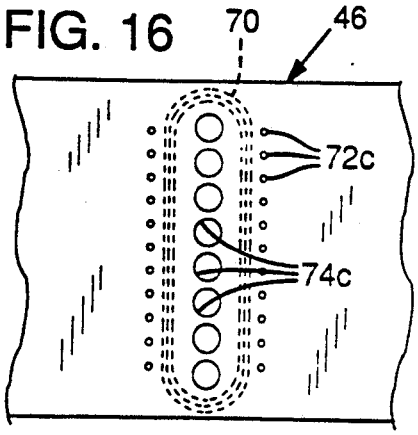
FIG. 16 is a fragmentary side view of a further alternate diaphragm embodiment of the apparatus of FIG. 10.

FIG. 16 shows an additional alternative embodiment, with diaphragm 46 having hinge perforations **72*c* defined in the diaphragm 46 as small diameter circular holes in a linear configuration. In this embodiment shown, about 20% of each row is perforated while about 80% of the diaphragm remains connected at each row. FIG. 16 further shows the optional mass reduction perforations 74*c***.

Figure 17:
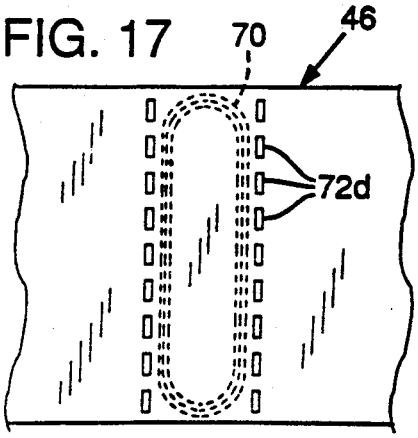
FIG. 17 is a fragmentary side view of a further alternate diaphragm embodiment of the apparatus of FIG. 10.

FIG. 17 shows a further alternative diaphragm 46 embodiment having elongated rectangular perforations **72*d*** that provide a hinge-line of approximately 50% perforated length and 50% connected length.

It will be appreciated that the perforations 72 located along the outside vertical edges of coil 70 can have a wide variety of shapes and sizes. The perforations 72, for example, have a diameter of about ¼ inch and are spaced apart about ¼ inch. Perforations **72*a* have a length of about ⅛ inch and are spaced apart about ¼ inch. Similarly, perforations 72*b* have a diameter of about ⅛ inch and a spacing of about ¼, and perforations 72*c*** have a diameter of about ⅛ inch and a spacing of about ¼ inch.

The increased flexibility and compliance which the perforations 72 provide the diaphragm is, in part, a function of the distance of the perforations from the vertical edge of the coil (which edge also defines the edge of the rigid central portion formed by adhering the two webs together). The perforations preferably eliminate diaphragm material along a hinge line within about ¼ inch and, most preferably, within ¼ inch or less of the vertical edges of the central joined-together portion of the webs. As this distance increases, spacing the perforations further from the coil, the increased flexibility and compliance drops off because the perforations are located farther from "hinge zone" on either side of the rigid beam-like central portion and hence farther from the primary high frequency radiator zone.

As the perforations move toward the coil to the point where they overlap the coil and extend into the rigid central portion area, the perforations cease to contribute increased flexibility but still improve the diaphragm performance to some extent by reducing the mass of the central portion which oscillates in response to th changing magnetic field.

For balance, it is important that the perforation pattern on both sides of a vertical line bisecting the coil be substantially symmetric. When web 60 in FIG. 13 is considered by itself, the perforations 116 do not provide a perfectly symmetric pattern as just noted. However, the webs 60 and 62 together do provide a balanced symmetry as FIG. 13 illustrates. It is also desireable that the perforation patterns above and below a horizontal line bisecting the coil also be symmetric.

Figure 18:
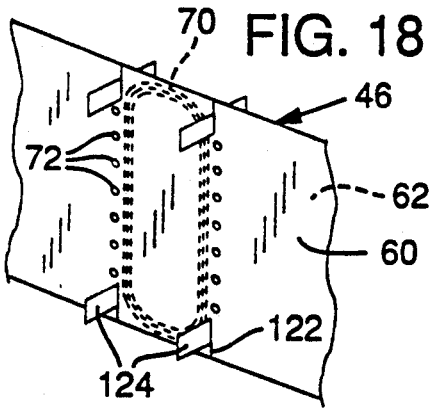
FIG. 18 is a fragmentary perspective view of an alternative diaphragm alignment arrangement of the apparatus of FIG. 3.

FIG. 18 shows an alternative approach for suspending and aligning the diaphragm 46 in the magnet gap 40. The diaphragm defines a pair of vertical slits 122 at both the upper and lower edges thereof, with the slits being aligned to register with the magnet pole plate surfaces 52 when the diaphragm is installed. An elongated rectangular tab 124 is inserted into each slit 122 so that it extends perpendicularly by an equal amount from each side of the diaphragm. Each tab is preferably formed of a strong and flexible sheet of material similar to the diaphragm. The free ends of each tab 124 are adhered to the magnet pole plates. The tabs have sufficient thickness that the diaphragm slits 122 do not shift or slide along the tabs during normal use. A deliberate force may be used to adjust the alignment during assembly.

Figure 19:
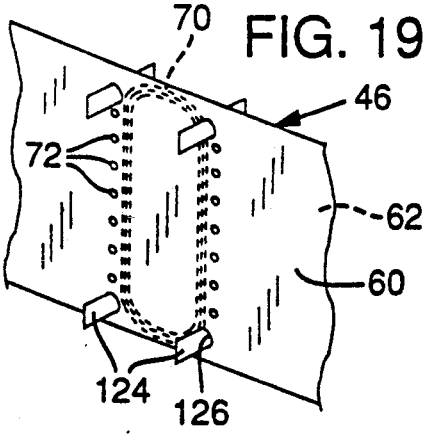
FIG. 19 is a fragmentary perspective view of a further alternative diaphragm alignment arrangement of the apparatus of FIG. 3.

FIG. 19 shows an alternative alignment approach using similar tabs 124 as in the embodiment of FIG. 18. Instead of retaining the tabs 124 in slits 122, however, the diaphragm defines tab holes 126 corresponding with the slit 122 positions of FIG. 18. The tab holes 126 are sized slightly smaller than the width of the tabs 124 so that the tabs resist sliding through the holes 126. The tabs 124 may thus need to be curved to pass through the holes when inserted during assembly. The tab holes 126 are shown as circular, but any shape, such as an ellipse or diamond, that snugly retains the tab 124 in a vertical plane is suitable.

Figure 20:
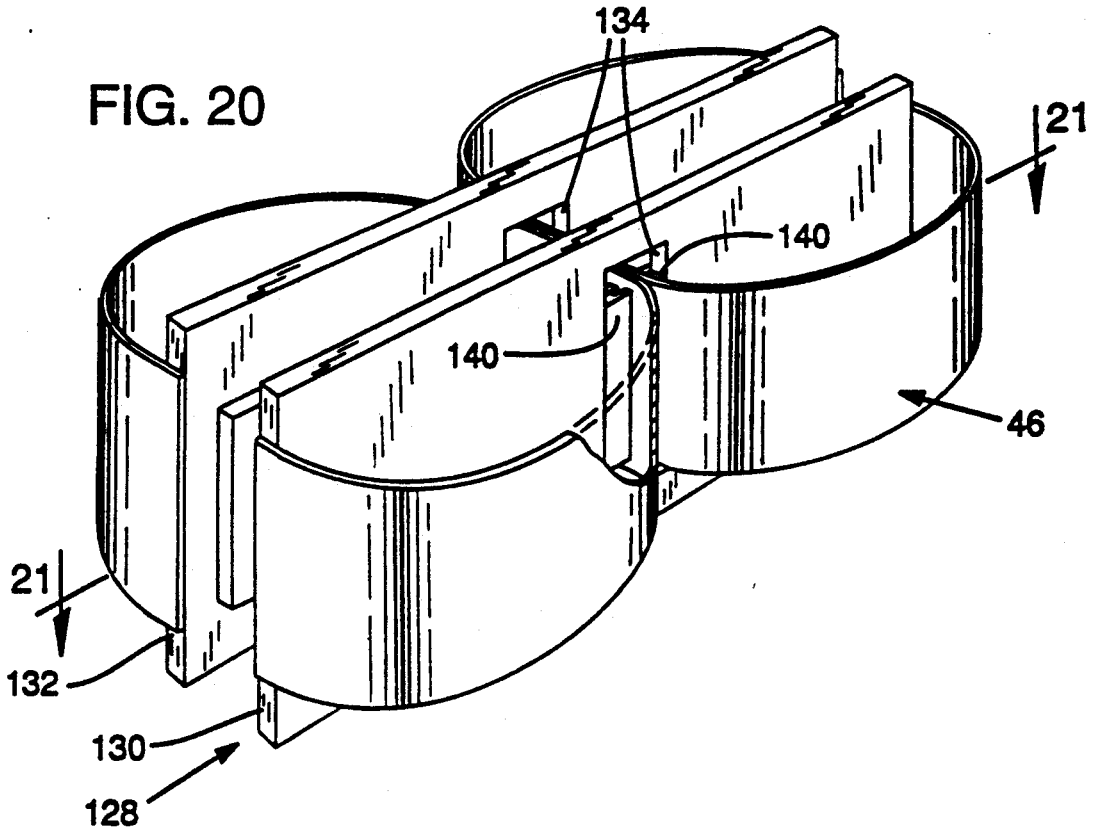
FIG. 20 is a perspective view of a high frequency transducer constructed in accordance with another embodiment of the invention.
Figure 21:
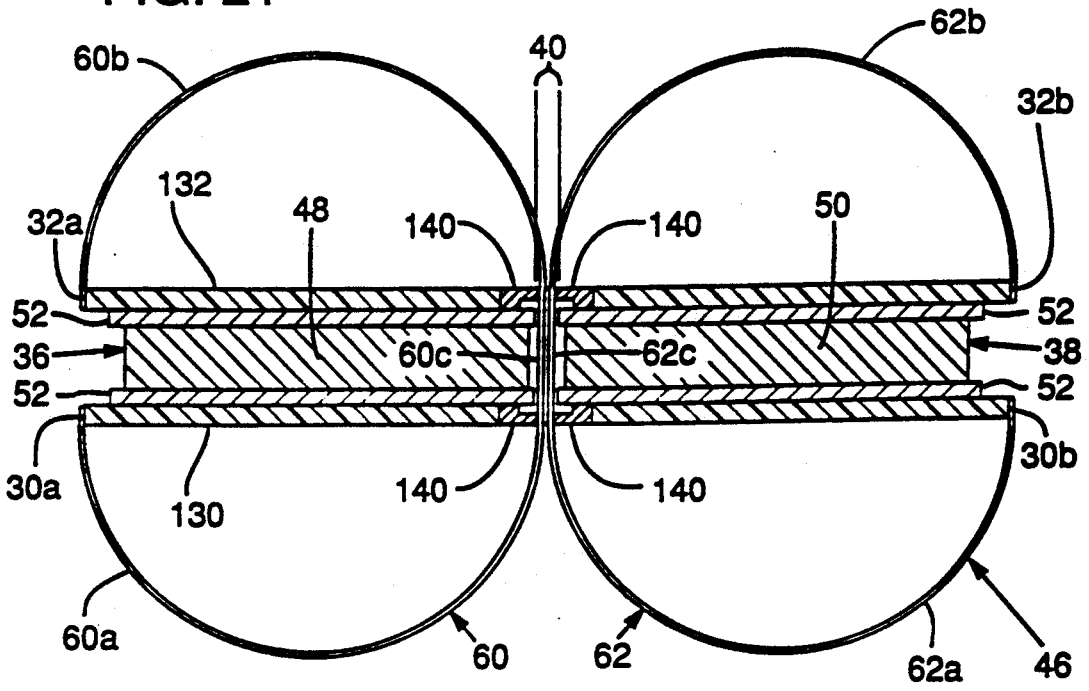
FIG. 21 is a cross-sectional view taken along 21—21 of FIG. 20.
Figure 22:
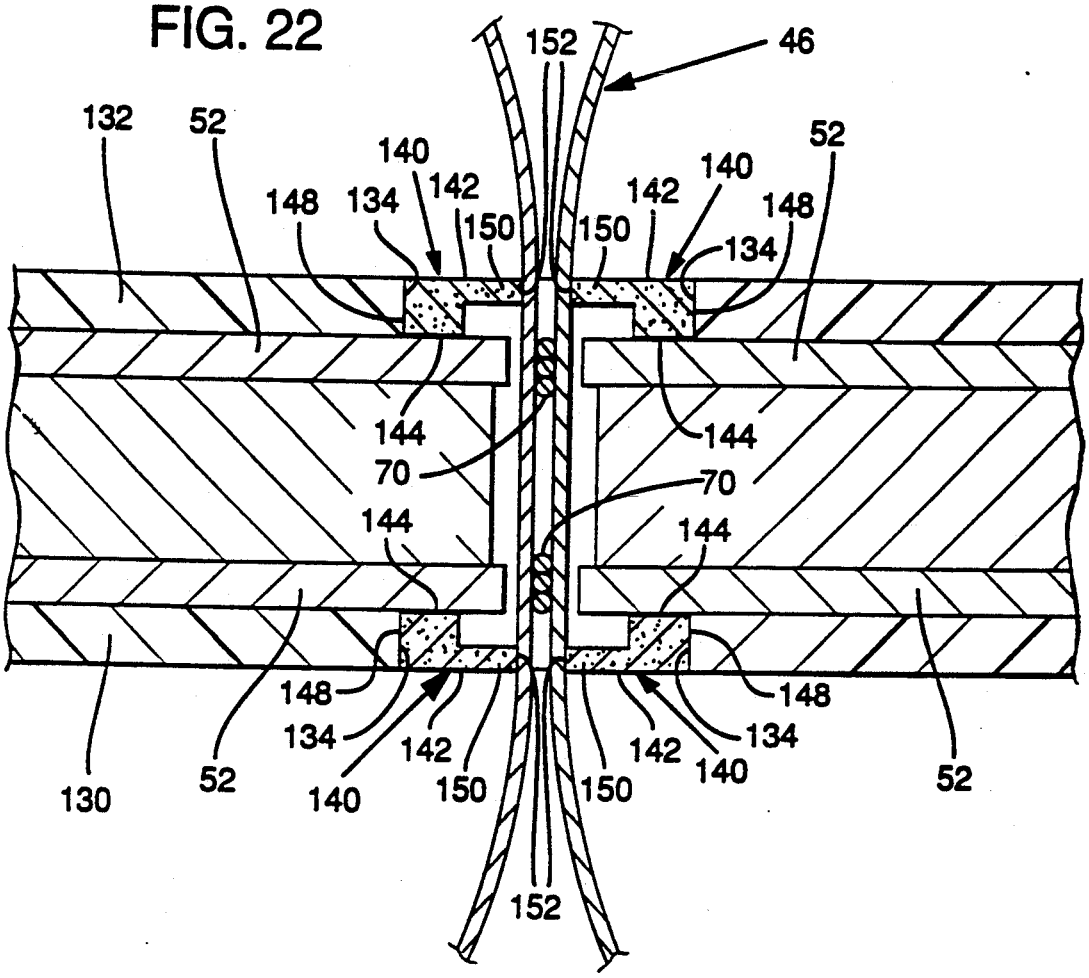
FIG. 22 is an enlarged cross-sectional view taken along line 21—21 of FIG. 20 showing the structure in the vicinity of the electrical coil.

FIGS. 20–22 show an alternative approach for suspending and aligning the diaphragm 46 in the magnet gap 40 of an alternative embodiment high frequency transducer 128. The illustrated embodiment is otherwise similar in function and structure to the embodiment of FIG. 3. A pair of parallel, laterally spaced chassis plates 130, 132 each define an elongated rectangular central aperture 134 to permit passage of the diaphragm 46. Each central aperture 134 is vertically oriented. The length of each aperture is greater than the height of the diaphragm 46 so that the diaphragm may pass freely through the aperture. The aperture length is also sufficiently less than the overall height of each chassis plate 130, 132 so that adequate chassis plate material remains above and below the aperture to provide a rigid structure. The width of each aperture 134 is preferably about ½ inch, but this may be adjusted to suit the size of other suspension components, as will be discussed below. The apertures 134 are centrally positioned on each chassis plate 130, 132, and centrally registered with the magnet gap 40 (shown in FIG. 21) so that the diaphragm 46 passes centrally through each aperture 134.

As shown in FIG. 21, four elongated flexible suspension strips 140 are inserted in the central apertures 134 to align and suspend the joined central expanse of the diaphragm in the desired position. A pair of suspension strips is positioned within each aperture 134 on opposite sides of the diaphragm 46. The suspension strips 140 are formed of a flexible closed cell foam with a pressure sensitive adhesive backing. The range of foam strip products sold as household weatherstripping provides a suitable selection of foam types and densities, with medium density closed-cell foam being preferred.

In the preferred embodiment, each strip 140 has a length generally corresponding to the height of the diaphragm 46. Alternatively, the length may be extended to the full height of the central aperture to provide a complete mechanical barrier against debris which might otherwise enter the magnet gap and cause interference with the motion of the diaphragm. The width of each strip 140 is preferably about ¼ inch. This permits the strips to entirely fill the width of each central aperture 134, with a slight compression due to the space occupied by the thickness of the diaphragm 46 between each pair of strips 140. Each strip has a thickness approximately equal to the thickness of the chassis plate 130, 132, or about ⅛ inch.

Figure 23:
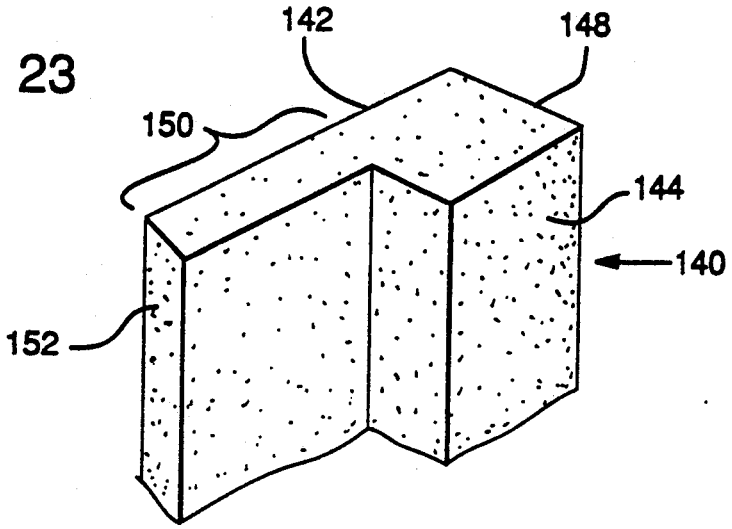
FIG. 23 is an enlarged perspective view of the suspension strip of the transducer of FIG. 20.

As shown in FIGS. 22 and 23, each suspension strip 140 has an L-shaped cross-section formed by removing a rectangular corner section from an original rectangular strip. The removed portion has width and thickness dimensions approximately equal to one-half those of the original rectangular strip, leaving three-quarters of the original material to form the suspension strip 140. Each strip 140 has a face surface 142 running the full width of each strip and an opposite base surface 144 running half the width of the strip due to the removed portion. The base surface 144 includes an adhesive layer, which securely attaches the strip by adhesion to the corresponding magnet pole plate 52.

Each strip includes a butt surface 148 running the full length and thickness of each suspension strip 140 and abutting the respective chassis plate 130, 132 within the central aperture 134. A cantilevered nose 150 extends away from the butt surface 148 and terminates in a nose end 152 which contacts the diaphragm 46. The nose 150 is spaced apart from the respective pole plate 52 and forms, in part, the face surface 142. The nose end 152 is preferably adhesively attached to the diaphragm to prevent accidental mechanical misalignment during shipping or use.

The nose 150 functions as a cantilever that suspends the diaphragm 46 at the free end of the cantilever. The nose flexes in compliance with vibration of the diaphragm, giving negligible resistance to the small amplitude vibrations in the high frequency range, but offering significant resistance to the larger amplitude vibrations at the lowest frequencies. This effectively provides a low frequency cutoff that may be adjusted to the advantage of the application by selecting the material properties and dimensions of the suspension strips 140.

The nose 150 may be made narrower or longer to create a less stiff cantilever, thereby increasing compliance and extending low frequency response. A thicker or shorter nose will diminish low frequency response by acting as a stiffer, less compliant cantilever. In addition, the density and flexibility of the selected suspension strip material may be varied to adjust effective cantilever stiffness, with lightweight open cell foam providing the greatest compliance for low frequency extension and denser foam or rubber material providing a firmer alignment useful for high frequency transducers. It is not necessary that the nose be rectangular; tapered versions are contemplated.

The primary advantage of the suspension strips 140 to align the diaphragm 46 is that all suspension forces are distributed equally along the vertical length of the active acoustical area of the diaphragm 46. This eliminates any distortions and interference that might arise from the focusing of suspension forces on discreet points or zones of the diaphragm. It is contemplated, however, that the suspension strips may be modified to contact the diaphragm at selected limited points. This may be provided by scalloping the nose end or by using spaced-apart segments of suspension strips along the length of the diaphragm.

It will be appreciated that while the use of alignment tangs, central mass reduction perforations, and hinge flexibility perforations works well, the principles of the present invention can be applied with fewer than all of the above features, or with only one of the selected features. In addition, the embodiment employing foam suspension strips has further advantages in manufacturability and sound quality, and may also incorporate the perforations illustrated in alternative embodiments.

Having illustrated and described the principles of my invention by what is presently a preferred embodiment, it should be apparent to those persons skilled in the art that the illustrated embodiment may be modified without departing from such principles. I claim as my invention not only the illustrated embodiment, but all such modifications, variations and equivalents thereof, as within the true spirit and scope of the following claims.

I claim:

1. An audio transducer comprising:

a pair of first and second magnet assemblies spaced apart by a magnet gap therebetween, each magnet assembly having a magnetic core and a pair of first and second magnetic pole plates of opposite magnetic polarity affixed to opposite sides of the magnetic core;

a chassis for maintaining the magnet assemblies in spaced relation;

a diaphragm comprising a pair of elongate curved webs having central portions joined together to form a movable expanse having a first side and an opposed second side and supported within the magnet gap such that the first magnet assembly is positioned on the first side of the expanse and the second magnet assembly is positioned on the second side of the expanse, each web having opposite end portions, each of which is affixed to the chassis, whereby the webs are supported such that they form a substantially figure eight pattern;

a pair of first and second distinct flexible diaphragm suspension strips attached in fixed relation to the magnet assemblies, the first strip being positioned entirely on the first side of the movable expanse, the second strip being positioned entirely on the second side of the expanse, the strips being in opposing contact with the movable expanse, such that the movable expanse is maintained centrally within the magnet gap while being free to move otherwise; and a coil attached to the expanse.

2. The transducer of claim 1 wherein the first suspension strip abuts the first side of the movable expanse and the second suspension strip abuts the second side of the movable expanse.

3. The transducer of claim 1 wherein the suspension strips are formed of flexible foam.

4. The transducer of claim 1 wherein the strips are elongated to contact the movable expanse along substantially the entire height dimension of the expanse.

5. The transducer of claim 1 wherein each suspension strip includes a base portion and a nose portion, the base portion being attached to one of the magnets, and the nose portion abutting the movable expanse.

6. The transducer of claim 5 wherein the nose portion extends away from the base portion in a cantilevered manner and has a length dimension which exceeds its thickness dimension.

7. The transducer of claim 1 wherein the suspension strips are biased against the movable expanse.

8. The transducer of claim 1 wherein the first and second suspension strips are in opposed relationship on one side of the magnet assemblies, and the transducer further includes a pair of third and fourth distinct flexible diaphragm suspension strips positioned on an opposite side of the magnet assemblies opposite the first side, the third an fourth suspension strips being positioned on opposite sides of and in abutting contact with the movable expanse.

9. An audio transducer comprising:

a chassis;

drive means attached to the chassis for creating a motive field, the drive means including a first portion and a second portion spaced apart by a drive gap therebetween, the chassis and drive means together comprising a diaphragm support structure;

a cylindrical diaphragm comprising an elongate curved web having a movable central expanse supported within the drive gap, the diaphragm having opposite end portions, each of which is affixed to the chassis;

a motion generating element attached to the central expanse for interacting with the motive field and thereby moving the diaphragm to generate sound; and a pair of first and second distinct flexible diaphragm suspension strips attached to the diaphragm support structure, each strip being positioned on opposite sides of the central expanse and abutting the central expanse, the central expanse being received between th strips such that the central expanse is maintained centrally within the drive gap while being free to move without contacting the diaphragm support structure.

10. The transducer of claim 9 wherein the strips are formed of flexible foam.

11. The transducer of claim 9 wherein the strips are elongated to contact the central expanse along substantially the entire height dimension of the central expanse.

12. The transducer of claim 9 wherein each strip includes a base portion and a nose portion, the base portion being attached to the diaphragm support structure, and the nose portion abutting the central expanse.

13. The transducer of claim 12 wherein the nose portion extends away from the base portion in a cantilevered manner and has a dimension which exceeds its thickness dimension length.

14. The transducer of claim 12 wherein the nose portion terminates at a nose end in abutting contact with the diaphragm.

15. The transducer of claim 9 wherein each strip is biased against the central expanse.

16. The transducer of claim 9 wherein the first and second strips are positioned in opposed relationship on one side of the drive means, the transducer further comprising a pair of third and fourth distinct flexible diaphragm suspension strips positioned on an opposite side of the drive means, in abutting relationship with the central expanse.

17. An audio transducer comprising:

a chassis;

a magnet assembly supported by the chassis and having first and second magnet elements spaced apart by a magnet gap, the first and second magnet elements creating a magnetic field in the magnet gap;

a sound-generating diaphragm including at least two arcuate web portions joined together at a central coil-carrying expanse located within the magnet gap, each web portion having opposed end portions affixed to the chassis, the central expanse having opposed first and second sides;

a first pair of distinct flexible suspension strips positioned on opposite sides of the first magnet element, each strip of the first pair being in abutting contact with a substantial linear portion of the central expanse;

a second pair of distinct flexible suspension strips positioned on opposite sides of the second magnet element, each strip of the second pair being in abutting contact with a substantial linear portion of the central expanse, whereby the first and second pair of strips abut from opposite abutting directions the central expanse to center the central expanse within the magnet gap while permitting the central expanse to move in a direction substantially tangential to the abutting directions.

18. The transducer of claim 17 wherein the first and second pair of suspension strips abuttingly contact the central expanse along respective substantially continuous linear portions of the central expanse.

19. The transducer of claim 17 wherein the first suspension strips each have a substantially "L" shaped cross-section including a cantilevered nose portion, the nose portion of each strip being in abutting contact with the central expanse.

20. The transducer of claim 19 wherein the strips are elongated and have a length substantially equal to the height dimensions of the central expanse.

* * * * *